United States Patent [19]

Negendank et al.

[11] Patent Number: 4,805,159

[45] Date of Patent: Feb. 14, 1989

[54] ACQUISTION OF A PROJECTILE TRAJECTORY PAST A MOVING TARGET

[75] Inventors: Helmut Negendank, Luebeck; Reinhard Wedekind, Hamburg, both of Fed. Rep. of Germany

[73] Assignee: Rhein-Flugzeugbau GmbH, Moenchengladbach, Fed. Rep. of Germany

[21] Appl. No.: 12,241

[22] Filed: Feb. 9, 1987

[30] Foreign Application Priority Data

Feb. 8, 1986 [DE] Fed. Rep. of Germany ..... 3603991
Apr. 12, 1986 [DE] Fed. Rep. of Germany ..... 3612352

[51] Int. Cl.[4] ..... G01S 5/18; F41J 5/12

[52] U.S. Cl. ..... 367/127; 434/1; 273/372; 273/360; 244/1 TD; 367/906

[58] Field of Search ..... 367/906, 127; 434/1; 273/372, 360; 244/1 TD

[56] References Cited

U.S. PATENT DOCUMENTS 4,323,993 4/1982 Söderblom et al. ..... 367/127
4,659,034 4/1987 Diekmann ..... 367/906

*Primary Examiner*—Thomas H. Tarcza
*Assistant Examiner*—Daniel T. Pihulic
*Attorney, Agent, or Firm*—Ralf H. Siegemund

[57] ABSTRACT

The minimum distance between a passing projectile and a training (dummy) target is ascertained by means of four shock wave responsive transducers in the target, two of which are aligned with the target's propagation and the transit time differential of receiving the shock wave from the projectile as well as measured distances to the projectile's trajectory are used to establish a set of possible projectile trajectories, one of them being the real one; all of them being arranged in rotational symmetry to the line established by the two transducers. This information suffices already to determine the minimum distance of fly by. A third transducer is used in relation to one of the two others to establish a second transit time difference by means of which the number of possible trajectories is narrowed to two being in mirror symmetrical relation to the plane established by the three transducers; the fourth transducer is used for detection of another transit time differential vis-a-vis any of the three others to resolve the remaining ambiguity concerning identification of the actual fly by trajectory.

3 Claims, 3 Drawing Sheets

ACQUISTION OF A PROJECTILE TRAJECTORY PAST A MOVING TARGET

BACKGROUND OF THE INVENTION

The present invention relates to acoustically determining deviations of a projectile from a minimal distance between a projectile and the target it passes under exclusion of transit time errors, particularly for application in movable training targets, under utilization of a suitable microphone system, cooperating with evaluating devices.

Generally speaking, methods for acoustically determining minimal distance deviations of a projectile from a resting training target or from a target moving with subsonic velocity, are based on the following consideration. The projectile is assumed to propagate with supersonic speed and produces a conical shockwave (Mach cone). These shockwaves are ascertained under utilization of at least one, usually several microphones. There is a relationship between the distance of the microphones from the shockwave generating point in any instant being a point on the path of the projectile, and the shockwave amplitude and/or the shockwave duration. These relationships are known. Moreover whenever the target is not moving, than one can derive from these relationships the shortest distance between the projectile represented by the point of shockwave generation, and that target.

It is also known, however, that in case of a moving target the direct measurement is apt to include errors so that, depending upon the various vectors describing the velocity of the projectile, the speed of the target, and the speed of sound, will only rarely yield a correct final result.

In order to avoid these errors one has to consider the spacial as well as the temporal history of the passage of the projectile past the target. For such a passage, one can, owing to the brevity of the process, approximate the target path, as well as the projectile trajectory to be straight lines, and the instantaneous velocity can be regarded as constant for such a short duration. However, any meaningful calculations in this regard are possible only if, in fact, one can relate the projectile path and trajectory to the actual propagation path of the target. For this then, two possibilities are known.

German printed patent application No. 31 22 644 describes a method of correcting information derived in relationship to a flying training target based on a geometry which considers the location of the projectile launching equipment and the target location. Here then it is required that the course, i.e. the path of the training target, is maintained very accurately and is, correspondingly, very accurately predetermined. The same is true as far as the altitude and the speed are concerned, and one needs exact distances from the projectile launch site and also the speed of the projectile; any changes of the speed have to be very accurately known. The microphones, moreover, have to be located in the center of the target and the entire arrangement requires an acoustic spherical characteristic.

Another possibility is described in European Pat. No. 3,095. Herein a three-dimensional arrangement is suggested which includes a system of microphones being comprised of at least four microphones and there is a supplemental system, so that all together five microphones are needed. One needs also a very accurately known target related geometry which renders the system independent from the altitude and the propagation course and path of the training target. The microphones, in this case, can be situated outside of the target center.

DESCRIPTION OF THE INVENTION

It is an object of the present invention to provide a new and improved arrangement and method which excludes transit time errors under utilization of a minimum number of microphones in a system of the type mentioned above. Sufficient information is to be made available, such information includes signal amplitude, duration, and propagation times, so that the number of parameters to be considered, for example, prior to a training mission, is very small.

It is, therefore, an object of the present invention to provide methods and equipment for ascertaining acoustically the trajectory of a projectile as well as deviations of the actual trajectory from a path intersecting the target, including acquiring the minimum distance of the projectile from the target as it passes (misses) the same under utilization of appropriate evaluating procedure in the evaluation.

In accordance with the preferred embodiment of the present invention, four spacially separated, acoustic pressure sensitive transducers (microphones for shock wave detection) are provided furnishing signals from which, on the basis of known physical relationships, one can derive relevant distances and geometric parameters of the projectile fly by solely on the basis of transit time differences and measured distances so that a minimum distance between target and projectile can be calculated in representation of the passage or near miss of the projectile as it flies past the target. Two of these transducers are on line with the propagation direction of the target. The transit time difference of the Mach cone receiving permits calculation of a set of trajectories arranged in rotational symmetry around that line. The additional transducers are arranged so that no three transducers are on a line and all four are not in common plane so that a single trajectory of the projectile can be selected from that set using additional transit time differences.

The inventive features offer the possibility to acquire the kind and amount of available information on the basis of a particular number of strategically arranged microphones having a specific relation to the target center so that in a step by step process using a minimal amount of information the projectile trajectory can be thin painted. In dependance upon functional and mechanical boundary conditions for the operation of the microphone system in the target considered as a unit, the target's geometry can be selected on the basis of optimization without compromising the basic aspects of data acquisition of the fly by situation.

DESCRIPTION OF THE DRAWINGS

While the specification concludes with claims particularly pointing out and distinctly claiming the subject matter which is regarded as the invention, it is believed that the invention, the objects and features of the invention, and further objects, features, and advantages thereof will be better understood from the following description taken in connection with the accompanying drawings in which the figures demonstrate in groups a stepwise increase in complexity in the acquisition of data relating the path of a projectile to or past a target.

Proceeding now to the detailed description of the drawings, FIG. 1 illustrates a diagram for explaining certain principles involved. Character $Z_M$ defines the geometric center of a target. It is assumed that we consider the time t=0, and that $Z_M$ is the point of origin of a three-dimensional coordinate system X, Y, and Z. It is furthermore assumed that at the time t=0 the target moves such that its center at that instance moves along the Z axis. On the other hand, a projectile is presumed at that same instant to be at the end of the vector R (t=0) and moves in the direction of vector G. The basic problem is, broadly, how to locate the projectile with reference to that target and narrowly (a) by how far will the target be missed and/or (b) what correction can be suggested so that the projectile will not miss the target.

The following equation describes the path or trajectory of the target:

$$Z = t\vec{Z} = t\begin{pmatrix} 0 \\ 0 \\ z_Z \end{pmatrix} \tag{1}$$

while simultaneously the projectile path or trajectory is described by:

$$G = \vec{R}(t=0) + t\vec{G} = \begin{pmatrix} x_R \\ y_R \\ z_R \end{pmatrix} + t\begin{pmatrix} x_G \\ y_G \\ z_G \end{pmatrix} \tag{2}$$

Figure 1:
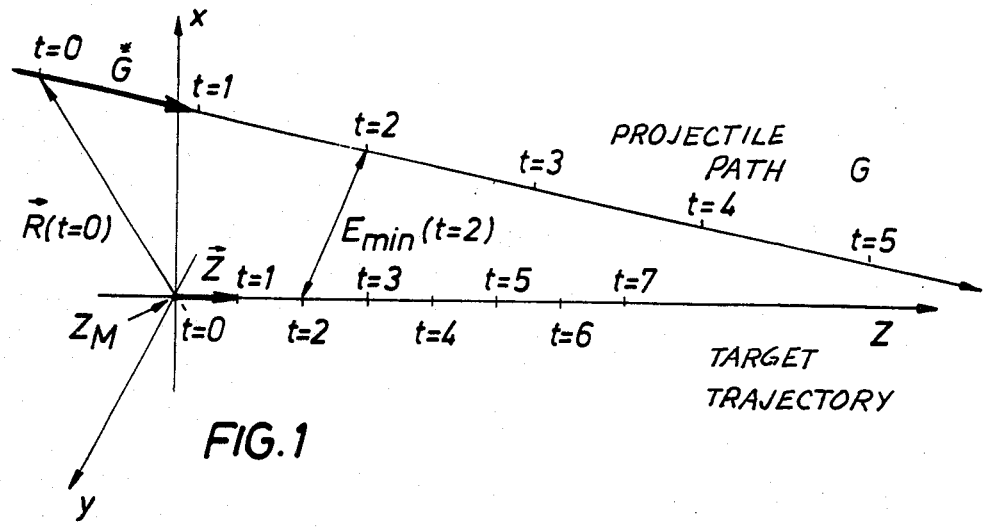
FIG. 1 is a vector diagram showing in principle the ascertaining of a minimum distance between a target and a projectile in any instant and for the most simple (linear) case of the geometric relations.

FIG. 1 shows for progressive instants t=1, 2, 3 . . . , both the progression of the target along the Z-axis and the progression of the projectile along a line or path. Accordingly, the instantaneous distance between target and projectile can be defined by:

$$E(t) = |\vec{G} - \vec{Z}| = \left|\begin{pmatrix} x_R \\ y_R \\ z_R \end{pmatrix} + t\begin{pmatrix} x_G \\ y_G \\ z_G - z_Z \end{pmatrix}\right| \tag{3}$$

-continued $$E(t) = [(x_R + t \cdot x_G)^2 + (y_R + t \cdot y_G)^2 + (z_R + t(z_G - z_Z))^2]^{0.5} \tag{3a}$$

This distance can be described to be a minimum distance if, in fact, $$\frac{dE(t)}{dt} = 0 \tag{4}$$

The shortest distance $E_{min}$, therefore, is given for the time $t_{min}$ in accordance with the following equation:

$$t_{min} = -\frac{[x_G \cdot x_R + y_G \cdot y_R + (z_G - z_Z) \cdot z_R]}{[(x_G)^2 + (y_G)^2 + (z_G - z_Z)^2]} \tag{5}$$

This particular value is to be used in equation (3a) in order to determine $E_{min}$.

Before we describe the system in detail, the following explanations, conventions, and definitions have to be introduced; they are common for all systems or models irrespective of any dimensional constraint.

A. The shortest distance between projectile and target is ascertained in four steps.

First, acquisition and transmission of the requisite acoustical data.

Second, calculation of the geometric location of the trajectory of the projectile in space, or of a group or set of such trajectories, whose elements have geometric relations to the target track which relation includes all the same information content.

Third, calculating the time parameter of the projectile, trajectory, and of target path.

Fourth, calculating the shortest distance between projectile and target during fly by.

The time parameters can be derived in an elementary form from the projectile velocity, the target speed, and the speed of sound as well as from the distance to that microphone that receives a signal first-in time. The calculations for the projectile trajectory will be explained later in the specification in greater detail.

B. The target is identified by at least two microphones having a well defined relation between them which relation defines in addition and basically arbitrary the target center. Microphone signals will be transmitted through a suitable telemetric method and device to a ground station which is equipped with a computer which carries out the requisite calculations.

C. If the effect of temperature and altitude are to be taken into consideration, then the actual speed of sound is determined in conjunction with the following equation that introduces the temperature δ in accordance with equation (6) which is: $c=331.6[1+\delta/273° C.]^{0.5}$m/s.

The temperature measurement must be carried out in the vicinity of the microphone(s) and that information is likewise telemetrically transmitted to the evaluating station.

D. As stated, at least two microphones are used. If there are just two, they are arranged, one behind the other, in the direction of the target movement. This holds true for two microphones even if there are more than two in the system. As stated, all microphone locations are assumed to be known in relation to the desired and, thus, defined target center.

E. The distances between the microphone(s) and the projectile trajectory are determined on the basis of known relationships between distance, shockwave amplitudes, and shockwave duration. Upon evaluating these types of information, it is also possible, within limits, to recognize the caliber of the projectile.

F. In the case of a fast moving target, a Doppler correction is necessary, modifying the measured pulse duration. For this, one needs to determine the angle of incidence of the shockwave generated by the projectile in relation to the direction of movement of the target. This angle is determined by measuring the difference in transit and sound acquisition time as between the various microphones mentioned under points B and D above.

G. The sound transit time differences are measured as between the various microphones, preferably under formation and evaluation of the respective cross correlation function of the signals detected by the microphones which participate in the process and system. This method is highly accurate, even in the case of a high noise level, and it furnishes also additional information (see, for example, patent application No. 700,404, filed Feb. 11, 1985). The microphones mentioned under point B and D will, for example, receive basically the same wind noise of the target. The cross correlation function, therefore, yields a maximum, the position of which permits the determination of the Mach number of the target, assuming, of course, that the speed of sound is known at that particular area (see point C).

H. The various calculations are carried out on the basis of known geometric acoustic relationships and for practical purposes, it is sufficient to assume that the propagation medium air is regarded to be at rest and homogeneous.

The shape of the Mach cone produced by the projectile is taken into consideration upon determining the trajectory of the projectile. It is thus not necessary to provide a simplifying approximation through the assumption of a planar wave front. On the other hand, a certain idealization is assumed as far as the Mach cone is concerned. Errors which are known to occur whenever the distances involved are small will be corrected in the processing and evaluating computing facility. Moreover, the microphones are assumed to be isotropic. Any deviations here can likewise be corrected on a calibrating basis, and these corrections, if necessary will be done by the computer; they just involve instrument particulars.

I. In order to simplify the geometry involved, the microphone system is regarded to be at rest in relation to the projectile in the sense that motion is represented by quasi-stationary but variable-in-time positions (except for separately considering the Doppler effect). Otherwise the inherent dynamics of a movable source is neglected. The microphone and target centers are, in fact, not actual the locations but idealized geometric locations which are ascertained from the sequence of sound reception (time differences) and from the separately considered target speed. Here then one takes the Mach cone into consideration and only the thus calculated locations will, in turn, enter into the calculation for the projectile trajectory. It was simply found that these simplifications introduce only insignificant and negligible errors.

Figure 2:
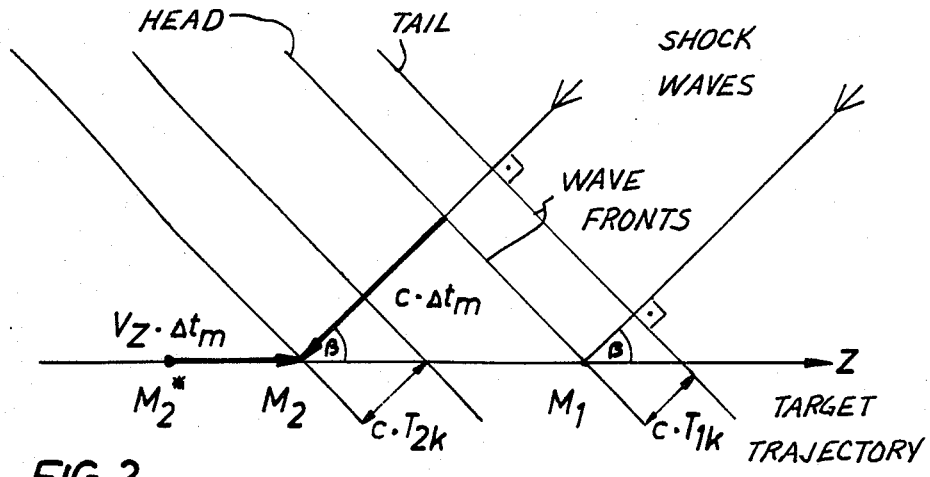
FIG. 2 is a schematic representation for explaining the Doppler effect correction, and for explaining the method of determining the location of a microphone under conditions laid out in FIG. 1.

FIG. 2 is, in fact, an illustration of an example for explaining the items F and I above (Doppler effect). Microphone $M_1$ is the first (in time) to receive a shock wave wavefront, and microphone $M_2$ will receive a signal from the same wave front after the time differential delta $t_m$ has elapsed. Since the distance between the two microphones, $M_1M_2^*$, is known, that distance has to be reduced by a particular distance value, calculated as $V_Z$.delta $t_m$, wherein $V_Z$ is the target speed. In case the sequence of sound reception is reversed, then the geometric microphone distance has to be extended by the same value. The angle of incidence beta of the shockwave, for the given speed of sound C is determined by equation 7:

$$\cos\beta = \frac{(c \cdot \Delta t_m)}{(M_1M_2^* \mp V_z \cdot \Delta t_m)} = \frac{(c \cdot \Delta t_m)}{(M_1M_2)} \tag{7}$$

$T_m$ is the measured pulse duration to be corrected for reasons of the Doppler effect compensation as per the following relation:

$$T_k = T_m[1 \pm (V_z/c)\cos\beta] = T_m\left[1 \pm \frac{(V_z \cdot \Delta t_m)}{(M_1M_2^* \mp V_z \cdot \Delta t_m)}\right] \tag{8}$$

It should be noted that the actual speed of sound does not have to be known in advance for obtaining this correction; the correction is in effect independent from the actual speed of sound between target and projectile.

In the case of a simple system, the target center is, in fact, situated on the axis Z of target movement, so are the microphones. This, in fact, reduces the system to a one-dimensional one. Owing to the rotational symmetry inherently involved in such a system, it does not permit, in fact, ascertaining the trajectory of the projectile in an unambiguous manner. Nevertheless, it yields significant results.

If one assumes a rotation of the actual projectile path around the Z axis, one generates a second order surface of rotational symmetry which has a linear generatrix. In the general case, it is a single shell (surface) hyperboloid with two sets of generatricies. Only this kind of hyperboloid will be considered in the following, and it includes the more simple and special cases of a circular cone, as well as of a circular cylinder, each requiring only one set of generatricies.

Figure 3:
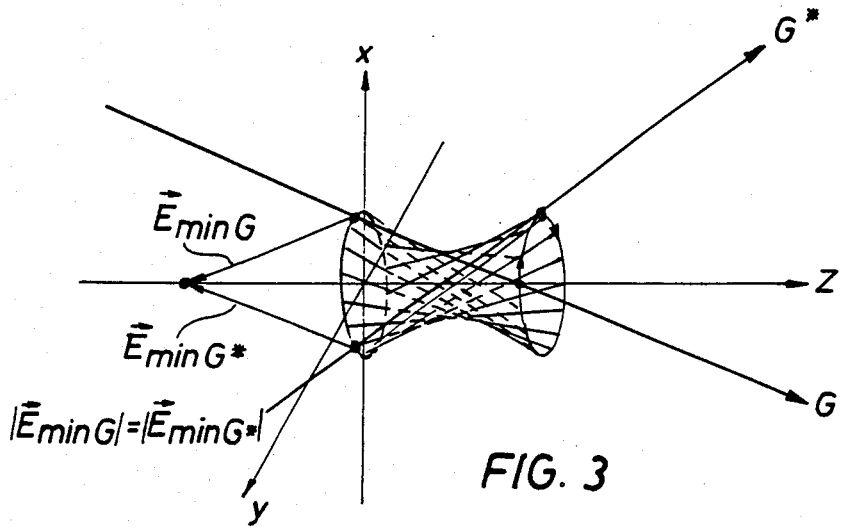
FIG. 3 is a perspective view of a rotational hyperboloid for explaining a variety of relevant parameters and quantities.

Such a rotational hyperboloid is depicted in FIG. 3. G and G* are individual, arbitrarily chosen generatrices of the two sets. One can see that owing to the rotational symmetry from each of arbitrarily selected generatrices the same information can be derived concerning the distance to any target center $Z_m$ situated on any spot on the Z axis. If the above defined distance $\vec{E}_{min}$ (equations 3a and 5) is ascertained as a set of rotating vectors, then the sign of the Z component determines whether or not the projectile will pass in front of or behind the target center (since the calculation involved should yield the same $\vec{E}_{min}$ for any generatrices). One can use any projectile path and trajectory G, which is conveniently located within the core in the system as far as the calculations are concerned.

Figure 4:
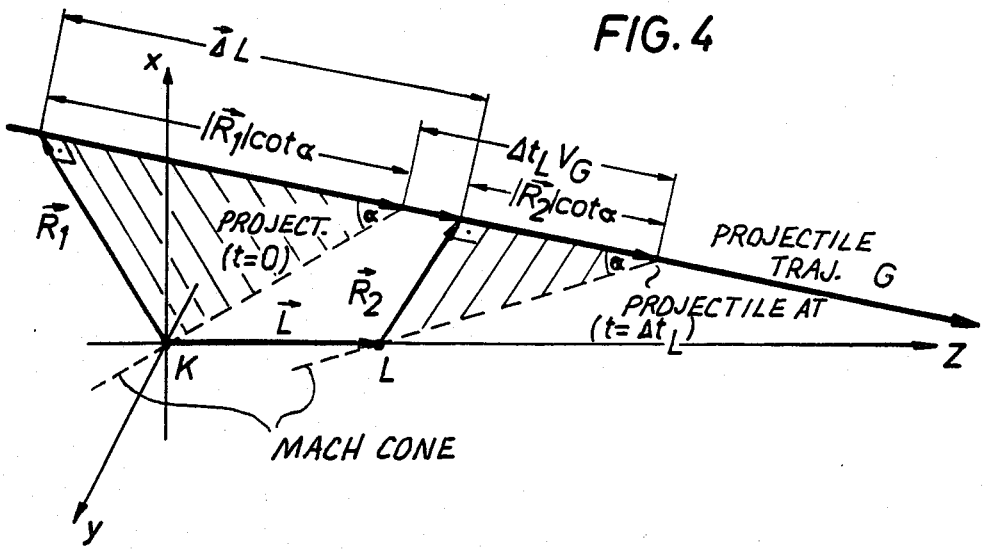
FIG. 4 is a spacial diagram with a microphone situated in the center of a coordinate system and showing a second microphone at the end of a vector of one of the axis of a three-dimensional coordinate system but data acquisition being simplified to a one dimensional model.

In FIG. 4 it is assumed that a first microphone, K, is situated in the point of origin in the coordinate system, while a second microphone, L, is situated at the end of the vector L on the Z axis. The location of the microphone L is, therefore, given by the following vector:

$$\vec{L} = \begin{pmatrix} 0 \\ 0 \\ z_L \end{pmatrix} \tag{9}$$

The distance vector $R_1$ is, therefore, placed into the XZ plane for purposes of simplifying the calculation and can be described by:

$$\vec{R_1} = \begin{pmatrix} x_1 \\ 0 \\ z_1 \end{pmatrix} \tag{10}$$

The vector $R_2$ as well as the vector $R_1$ are both at right angles to the projectile path G. However, for the vector $R_2$ none of its components can be assumed to be zero.

$$\vec{R_2} = \begin{pmatrix} x_2 \\ y_2 \\ z_2 \end{pmatrix} \tag{11}$$

The distance between vector $R_1$ and vector $R_2$ on the projectile trajectory G is $$\vec{\Delta_L} = \vec{L} + \vec{R_2} - \vec{R_1}. \tag{12}$$

Let alpha be the Mach cone angle, and $M_G$ be the Mach number of the projectile, then the projectile velocity $V_G$ is given by:

$$M_G = (V_G)/(c) = \text{cosec (alpha)} \tag{13}$$

If delta $t_L$ is a measured difference in time of the signal reception by the two microphones K and L (i.e. the difference in time in receiving the leading edge of the shock wave pulse attributable to the Mach cone of the projectile), then the projectile propagates during that time by the distance delta $t_L.V_G$ so that the following equation holds:

$$|\vec{\Delta_L}| = \Delta t_L \cdot V_G + (|\vec{R_1}| - |\vec{R_2}|) \cot \alpha = \Delta t_L \cdot V_G + (|\vec{R_1}| - |\vec{R_2}|) \cdot [(M_G)^2 - 1]^{0.5} \tag{14}$$

Herein one knows the quantities C, $V_G$, $M_G$, and vector L, while the scalar values $R_1$ and $R_2$, and the time differential delta $t_L$ are measured. From this then one can calculate the components or elements for the vectors $R_1$ and $R_2$, and that result fixes and determines the projectile trajectory.

As per FIG. 4 we use the following equation system:

$$|\vec{\Delta_L}|^2 = (x_2 - x_1)^2 + (y_2)^2 + (z_L + z_2 - z_1)^2 \tag{15}$$

$$|\vec{R_1}|^2 = (x_1)^2 + (z_1)^2$$

$$|\vec{R_2}|^2 = (x_2)^2 + (y_2)^2 + (z_2)^2$$

$$0 = \vec{R_1} \cdot \Delta_L$$

$$0 = \vec{R_2} \cdot \Delta_L$$

This system of five equations when resolved will yield determining equations for the five unknown components:

$$z_1 = \frac{|\vec{R_1}|^2 - |\vec{R_2}|^2 + (z_L)^2 - |\vec{\Delta_L}|^2}{2z_L} \tag{16}$$

$$z_2 = \frac{|\vec{R_1}|^2 - |\vec{R_2}|^2 - (z_L)^2 + |\vec{\Delta_L}|^2}{2z_L}$$

$$x_1 = +\left[ |\vec{R_1}|^2 - \frac{(|\vec{R_1}|^2 - |\vec{R_2}|^2 + (z_L)^2 - |\vec{\Delta_L}|^2)^2}{4(z_L)^2} \right]^{0.5}$$

Let us denote $[2(z_L)^2|\vec{R_1}|^2 + 2(z_L)^2|\vec{R_2}|^2 + 2|\vec{R_1}|^2|\vec{R_2}|^2 + |\vec{\Delta_L}|^4 - |\vec{R_1}|^4 - (z_L)^4]$ by A, $z_1$ by C and $z_2$ by B for the sake of ease in writing out the following equations:

$$x_2 = +\frac{A}{4(z_L)^2[|\vec{R_1}|^2 - C^2]^{0.5}}$$

$$y_2 = +\left[ |\vec{R_2}|^2 - \frac{A^2}{4(z_L)^2[4(z_L)^2|\vec{R_1}|^2 - C^2 4(z_L)^2]} - B^2 \right]^{0.5}$$

This solution indicates that for recognizing the passage of the projectile in front or behind the target one obtains the desired Z component of the relevant distances. The sign of $x_1$ and $y_2$ are freely selectable. The sign of $x_2$ must be the same as $x_1$, because $x_1$ is included in $x_2$.

Therefore, through the equations above, four explicite solutions obtain, having mirror symmetry to the XZ plane, as well as to the YZ plane. However, none of the solutions has to be the actual projectile path. On the other hand, for calculating the shortest distance one can arbitrarily select any path as per the following relation:

$$G = \vec{R_1} + t\vec{\Delta_L} \tag{17}$$

(wherein t is the time parameter).

Upon using a third microphone outside of the Z axis, the microphone system is expanded to a two-dimensional one. Now, it is possible to select from the aforedescribed set of projectile trajectories just two trajectories which are placed in relation to the plane of the three microphones in mirror symmetry relation. In other words, each of the two groups or sets of trajectories provides one solution. Therefore, the desired target center does not have to be situated any longer on the Z axis, but anywhere within the plane of the three microphones. Also, it is possible to define target areas within that plane, for example, in the form of a planar silhouette contour of the particular target vehicle. If the target is being attacked from within but one of the two spaces into which the plane of the microphone defines all of the space, then the path and trajectory of the projectile is no longer ambiguous, and one can define and establish a target body.

Figure 5:
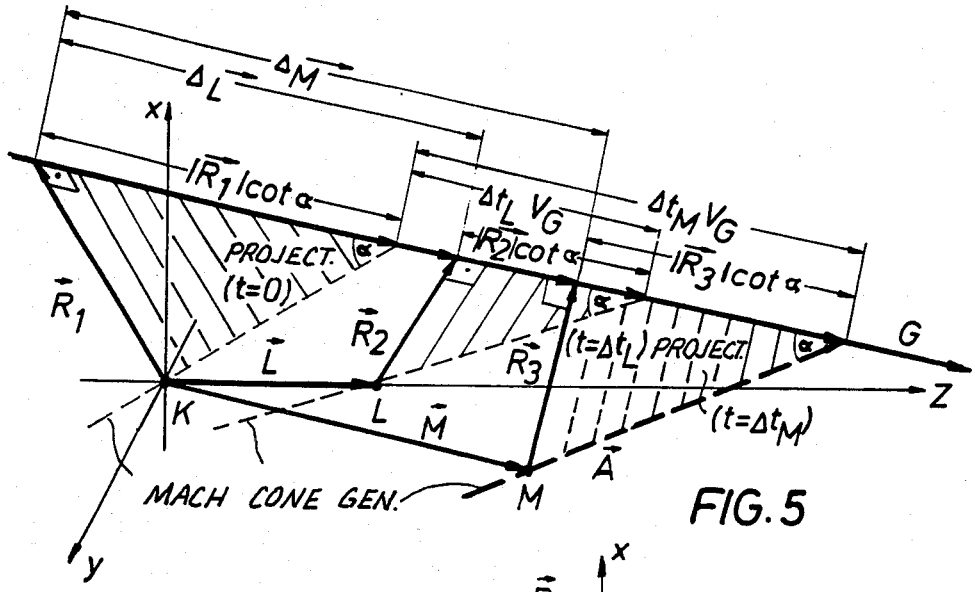
FIG. 5 is a spacial diagram with three microphones, establishing a particular plane for demonstrating the next step by means of which acquisition is expanded to a two dimensional model.

FIG. 5 illustrates a planar microphone system. It corresponds basically to the system shown in FIG. 4, but a third microphone M has been added. Again, in order to simplify the calculation it is assumed that this third microphone is situated in the XZ plane, and the vector M points to the (hypothetical, geometric) location of that microphone, $$\vec{M} = \begin{pmatrix} x_M \\ 0 \\ z_M \end{pmatrix} \tag{18}$$

$\vec{R}_3$ is a vector defining the distance of location M from the trajectory path G, and the distance between $\vec{R}_1$ and $\vec{R}_3$ on G is given by:

$$|\vec{\Delta}_M| = \Delta t_M \cdot V_G + (|\vec{R}_1| - |\vec{R}_3|)[(M_G)^2 - 1]^{0.5} \tag{19}$$

Herein, delta $t_M$ is a measured time difference between signal reception of the microphones K and M. The magnitude of the vector distance $R_3$ is likewise measured. Vectors $\Delta_M$ and $\Delta_L$ are both situated on G, so that the following relations obtain:

$$\vec{\Delta}_M = Q\vec{\Delta}_L \text{ where } Q = |\vec{\Delta}_M| / |\vec{\Delta}_L| \text{ and}$$
$$\vec{R}_3 = \vec{R}_1 + \vec{\Delta}_M - \vec{M} = (1-Q)\vec{R}_1 + Q(\vec{L} + \vec{R}_2) - \vec{M} \tag{20}$$

If G runs parallel to the XY plane, then $|\vec{\Delta}_L| = 0$. And since vector $R_1$ is assumed to be in the XZ plane, $\vec{\Delta}_M$ has to be parallel to the Y axis. Therefore, in a somewhat simplified version, one does not need Q above. In the following, only the more complex situation of $|\vec{\Delta}_L| \neq 0$ is considered.

In order to determine the desired pair of projectile paths, as defined above, one will select arbitrarily a single projectile trajectory from the group or set, while computing on the basis of rotation of M about the Z axis, until the conditions of the systems of equations are fulfilled. The coordinate of the microphone to be rotated by the angle psi ($\Psi$) is then given by:

$$M_\psi = \begin{pmatrix} x_{M\psi} \\ y_{M\psi} \\ z_M \end{pmatrix} = \begin{pmatrix} x_{M\psi} \\ [(x_M)^2 - (x_{M\psi})^2]^{0.5} \\ z_M \end{pmatrix} \tag{21}$$

Figure 6:
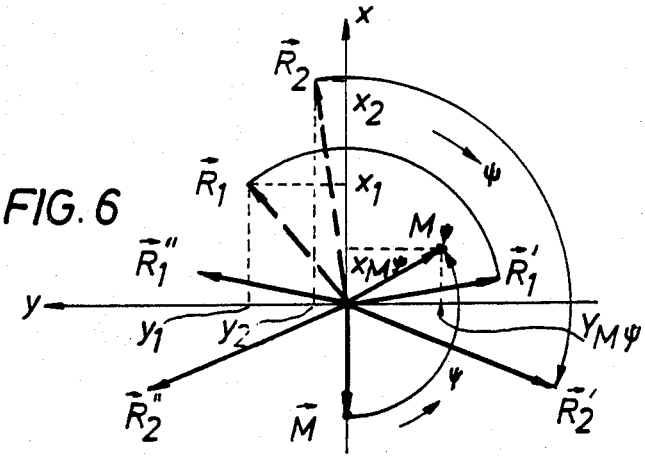
FIG. 6 is a diagram for explaining a coordinate transformation relevant in the system for two dimensional model.

FIG. 6 illustrates this coordinate transformation as a projection into the XY plane. The selected trajectory is given by the distance vectors $R_1$ and $R_2$ and the distance vectors of the actual projectile path $\vec{R}'_1$ and $\vec{R}'_2$ are given through the opposing rotation of $\vec{R}_1$ and $\vec{R}_2$ about the desired angle, given by $$\Psi = \arctan(y_{M\Psi}/x_{M\Psi}) \tag{22}$$

The vector M is known, $|\vec{R}_3|$ and $t_M$ are to be measured, and $x_{M\Psi}$ and $y_{M\Psi}$ are to be determined. In accordance with FIGS. 5 and 6 we can begin with the following equation system:

$$|\vec{R}_3| = |(1-Q)\vec{R}_1 + Q(\vec{L} + \vec{R}_2) - \vec{M}_\psi| \tag{23}$$
$$0 = \vec{R}_3 \cdot \vec{\Delta}_L$$
$$y_{M\psi} = \pm[(x_M)^2 - (x_{M\psi})^2]^{0.5}$$

This yields the following solution:

$$x_{M\psi} = \frac{1}{2x_1}[(x_1)^2 + (x_M)^2 + (z_1)^2 + (z_M)^2 - 2z_1z_M - |\vec{R}_3|^2 + Q^2(-(x_1)^2 - (x_2)^2 - (y_2)^2 + 2x_1x_2 - (z_1)^2 - (z_2)^2 - (z_L)^2 + 2z_1z_2 + 2z_1z_L - 2z_2z_L)] \text{ and} \tag{24}$$

-continued $$y_{M\psi} = +[(x_M)^2 - (x_{M\psi})^2]^{0.5}$$

Two solutions exist for $y_{M\Psi}$ owing to the rotational symmetry on the XZ plane. The particular projection as per FIG. 6 of the solution in the XY plane, therefore, has to be mirror imaged on the X axis (vectors $R_1''$, $R_2''$).

Another equation system, however, can be used for determining a pair of projectile trajectories. For this one introduces the generatrix vector $\vec{A}$ (see FIG. 5) of the Mach cone. The rotation of M will then be carried out such that $\vec{A}$ and G just have the Mach angle alpha between them, and the scalar value of the vector $R_3$, namely, $|\vec{R}_3|$ does not have to be measured any longer.

Next, we proceed to expand the two-dimensional, three microphone system by placing a fourth microphone outside of the XZ plane, assumed to contain the three microphones K, L and M. This then permits an unambiguous determination of the projectile path and trajectory under any conditions.

Figure 7:
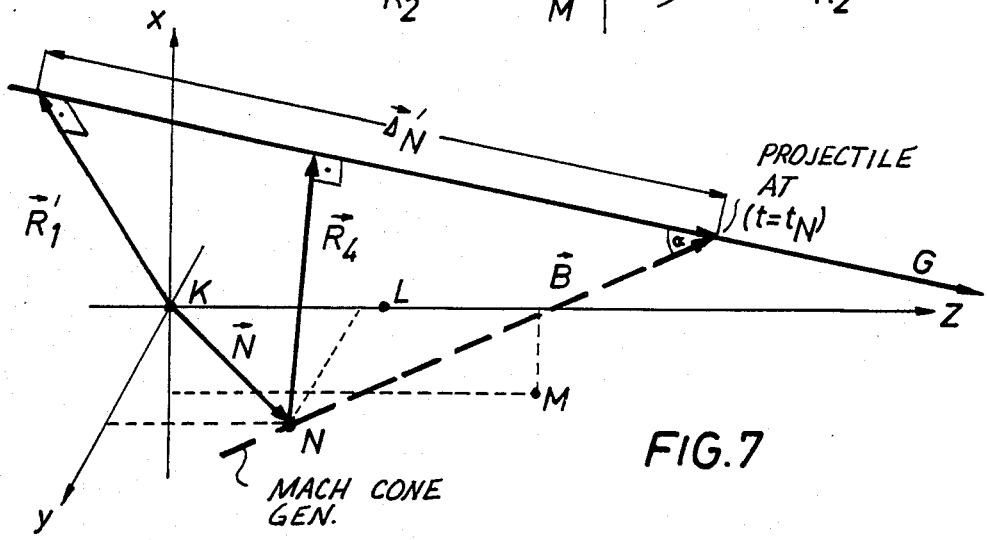
FIG. 7 is a diagram for a full three-dimensional data acquisition system using four microphones.

FIG. 7 shows the fourth microphone N, and it is assumed to be situated in the YZ plane. The vector N, describes for purposes of calculations the location of that microphone. Several different equations can be used in order to obtain the solution. For example, as was already mentioned, one can begin with the measured distance $|\vec{R}_4|$ among microphone N and the trajectory and the scalar product among the two possible track vectors. Or one may calculate the rotation of the microphone N about the Z axis. In the latter case, one will obtain a dual solution which is symmetrical to the YZ plane, one of which is identical with that solution obtained with the aid of the microphone M. One may also begin with a set of equations using the Mach cone angle alpha ($\alpha$) without knowing the distance $|\vec{R}_4|$. In accordance with FIG. 7, one obtains in this case:

$$\vec{\Delta}_N \cdot \vec{B} = |\vec{\Delta}_N| \, |\vec{B}| \cos \alpha. \tag{25}$$

As was discussed above on the basis of the preceding calculations, $|\vec{\Delta}_N|$ results from one of the possible transit time differences, for example, between the microphones N and K. The generatrix vector B for the Mach cone does then result from the vector sum:

$$\vec{B} = \vec{N} - \vec{R}_1' - \vec{\Delta}_N. \tag{26}$$

If the resulting vector does not fulfill the requirements of the above-mentioned scalar product, then there is only the other possibility which unambiguously determines the projectile path, namely $\vec{R}_1''$ and $\vec{\Delta}_N''$.

It can be seen that the target center can be arbitrarily selected in space on the basis of sets of equations and the resulting solutions, which means that under all possible target situations a target body can be defined in the evaluating computer.

The invention is not limited to the embodiments described above, but all changes and modifications thereof, not constituting departures from the spirit and scope of the invention are intended to be included.

We claim:

1. A method of determining passage of a projectile past a training target having a plurality of microphones for the detecting shock waves, further including telemetric facilities for transmitting signals produced by the microphones to ground, comprising:

arranging two of said microphones on a line colinear with a direction of propagation of the training target and at a particular distance from each other;

detecting receiving of a Mach cone shock wave by each of the microphones including determining any transit time difference; and determining a set of projectile trajectories each having a similar minimum distance from the target, the set being a plurality of generatrices of a surface having rotational symmetry to a connecting line between said two microphones.

2. A method as in claim 1 including using a third additional microphone defining a plane together with said two microphones;

determining the transit time difference of receiving the Mach cone shock wave by said third microphone relative to one of said two microphones and/or the distance between the additional microphone and the trajectory; and determining two mirror symmetrically positioned trajectories from said set on the basis of said latter transit time difference.

3. A method as in claim 2, including a fourth additional microphone outside of said plane for selecting one of said two trajectories by detecting the transit time difference of Mach cone shock wave received by the fourth microphone in relation to one of the two or to the third microphone and/or the distance between the fourth microphone and the trajectory.

* * * * *